United States Patent [19]

Goldberg

[11] 4,375,631

[45] Mar. 1, 1983

[54] JOYSTICK CONTROL

[75] Inventor: Thomas R. Goldberg, Golden, Colo.

[73] Assignee: Ampex Corporation, Redwood City, Calif.

[21] Appl. No.: 252,710

[22] Filed: Apr. 9, 1981

[51] Int. Cl.[3] ..... H01C 10/16

[52] U.S. Cl. ..... 338/128; 74/471 XY

[58] Field of Search ..... 338/128; 74/471 XY

[56] References Cited

U.S. PATENT DOCUMENTS

| | | | |
|---|---|---|---|
| 3,308,675 | 3/1967 | Jonsson | 338/128 |
| 3,365,975 | 1/1968 | Hathaway | 338/128 X |
| 3,745,966 | 7/1973 | Seager | 338/128 X |

*Primary Examiner*—C. L. Albritton

*Attorney, Agent, or Firm*—Charles M. Carman, Jr.; Joel D. Talcott

[57] ABSTRACT

A manually-operable joystick is mounted for universal pivoting motion as by means of spherical bearing and journal means and is biased toward a neutral position so as to return automatically thereto upon release of manual constraint.

7 Claims, 5 Drawing Figures

JOYSTICK CONTROL

BACKGROUND OF THE INVENTION

This invention relates to joystick controls and particularly to such controls having universal pivoting motion for manual operation.

In the joystick control art it is frequently desirable to provide means for signalling the instantaneous inclination of the joystick in two or more orthogonal planes. Such means, for digital use, are disclosed in U.S. Pat. No. 4,161,726 (Burson, et al.). However, it is also often desirable to have the joystick return to vertical position when manual constraint is released.

Accordingly, it is an object of this invention to provide a manually operable joystick that returns to neutral position when manual constraint is released.

It is a further object of the invention to provide a joystick as above described and having provision for manually induced signals in the vertical position.

Figure 1:
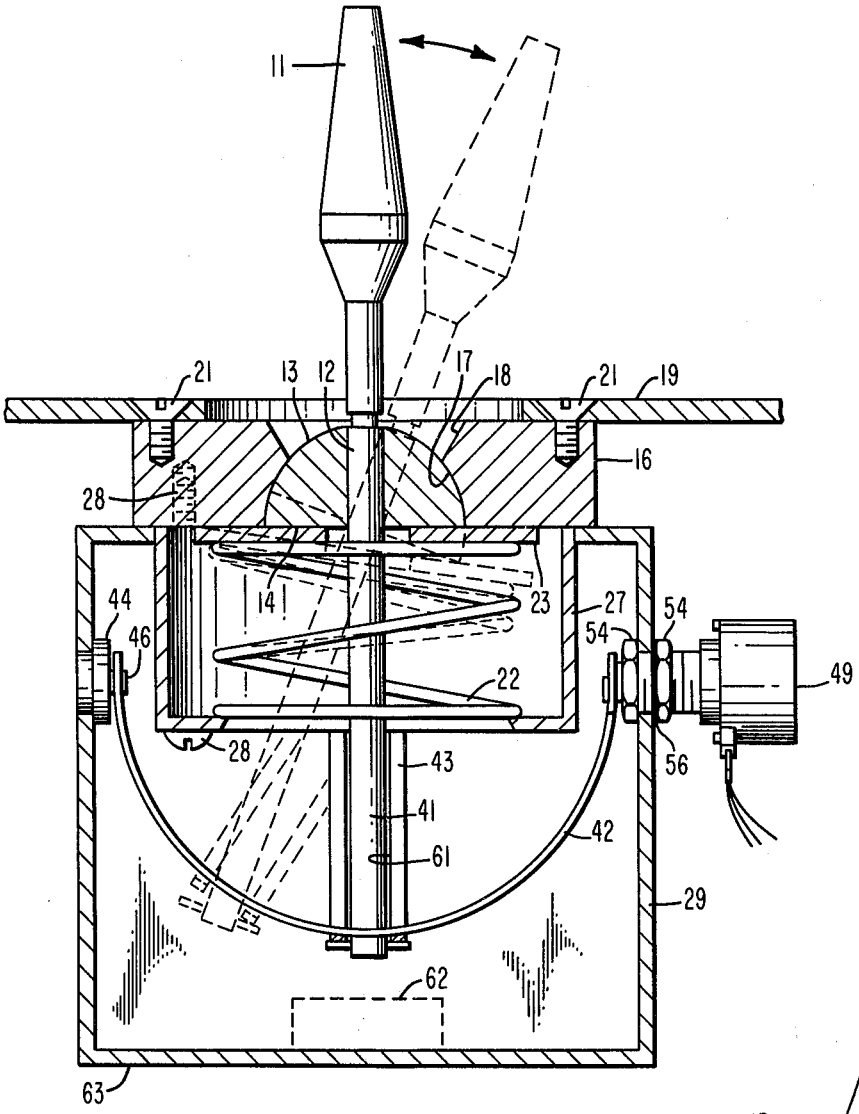
FIG. 1 is a cross-sectional elevation view of an embodiment of the invention.
Figure 4:
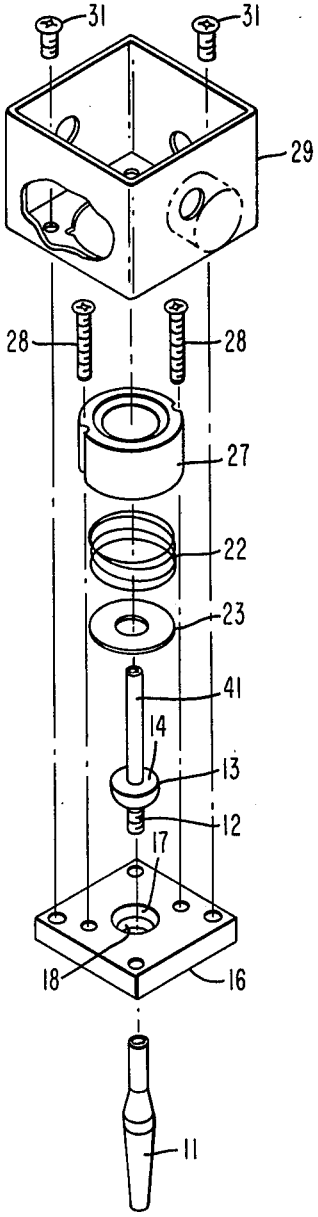
FIG. 4 is an inverted exploded perspective view to a smaller scale of a portion of the apparatus shown in FIG. 1.
Figure 5:
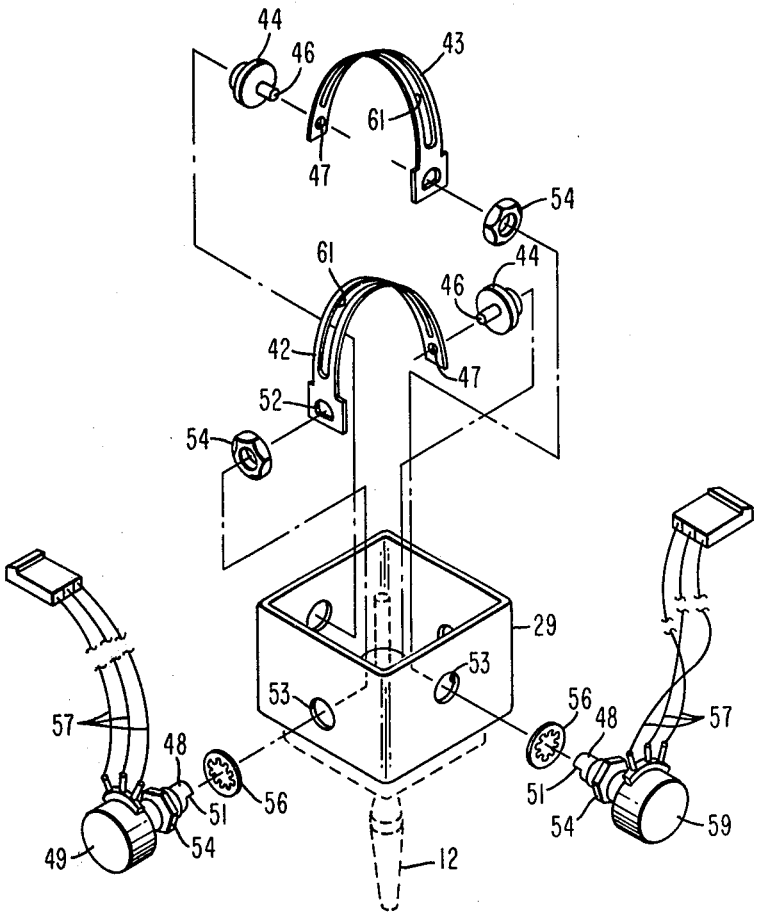
FIG. 5 is an inverted exploded perspective view (to the scale of FIG. 4) of another portion of the apparatus shown in FIG. 1.

Referring now to the drawings and particularly to FIGS. 1 and 4 thereof, there is shown a manually-operable joystick handle 11 screw-coupled to a shank member 12, which is press-fitted into a substantially hemispherical bearing member 13 along the central polar axis thereof and with the handle 11 on the polar side thereof, i.e., on the side opposite the equatorial flat side 14. The joystick and bearing are mounted for universal pivoting motion throughout a range of inclinations, as by means of a journal member 16 which has a hemispherical cavity 17 conforming to the hemispherical surface of member 13. The range of inclinations of the joystick is limited and defined by the frustoconical inner surface 18 of a through opening in member 16 for the passage of the joystick, and the assembly is mounted to the top plate 19 of a chassis as by means of bolts 21.

Now, it is desirable in the environment in which the present invention is to be used, that the joystick 11 return automatically to the upstanding neutral position illustrated in solid lines in FIG. 1, whenever manual constraint is released.

To accomplish this end, a helical coil compression spring 22 is arranged to bear in compression against the equatorial flat side 14 of the bearing member 13. If the spring is of smaller diameter that the member 13, it can bear directly against the side 14 thereof, but improved leverage is gained by using a spring of greater diameter than the member 13 and arranging to have it bear through an intervening circular plate 23.

Figure 2:
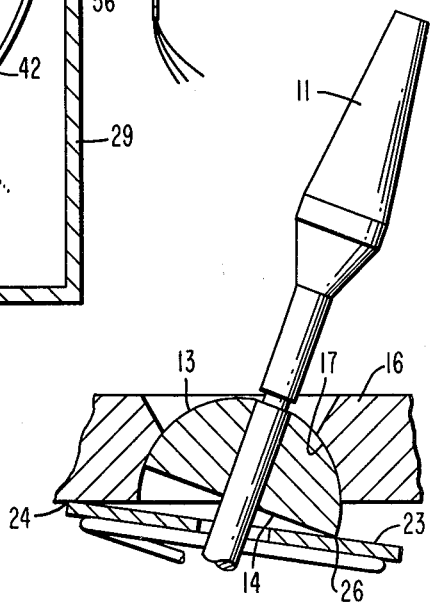
FIG. 2 is a fragmentary cross-sectional view of a different position of portions of the apparatus shown in FIG. 1.

Thus, whenever the joystick is tilted out of the neutral position, as illustrated in phantom in FIG. 1, and for greater clarity in solid lines in FIG. 2, the plate forms in effect a lever with fulcrum at point 24 where the edge of the plate is tangent to and bears against journal member 16, and exerts a restoring moment against the diametrically opposite point 26, where the edge of the equatorial flat side 14 of member 13 that protrudes from the cavity 17 comes tangent to plate 23. This restoring moment acts upon the member 13 and the joystick in a rotational direction to restore the joystick to neutral position whenever it is released from manual constraint.

Mechanical details of the assembly are as follows:

The spring 22 is retained in stressed condition as by means of a retaining cup 27, which is secured to the journal member 16 as by bolts 28, and other portions of the apparatus (to be later described) are mounted on an enclosing box-like housing 29, which is secured to member 14 as by means of screws 31.

Bail and signal means are also provided for positioning by the joystick to provide signals indicative of the inclinations of the joystick in two planes orthogonal to each other and to the (e.g., horizontal) plane in which lies the top plate 19. One (the first) of the planes in which the inclination is to be sensed may be taken as e.g. the plane of the paper in FIG. 1, and the second of the planes may be taken as normal to the first and parallel to the joystick in its illustrated neutral (vertical) position.

To sense inclinations in the first and second planes, an extension 41 of the joystick is caused to pivot a pair of semi-circularly curved bail members 42 and 43, which are pivoted on axes passing through their ends and lying in the first and second planes, respectively. Particularly, bail 42 is pivoted at one end by means of a pivot pin member 44 mounted in a side wall of the box 29 and having a pin portion 46 penetrating a corresponding pivot hole 47, while the other end is keyed to a shaft 48 of a rotating potentiometer 49, the shaft having a key flat 51 and the bail having a conforming flat-sided hole 52 to mate with the shaft. The potentiometer is secured to the box 29 at an opening 53 by means of a pair of nuts 54 and a lock washer 56, and has electrical leads 57 for transmitting a signal indicative of the angular position of the shaft 48 thereof. A second potentiometer 59 is correspondingly secured to the box in the second plane above described and is similarly coupled to the other bail 43, and bail 43 is similarly pivoted by means of similar elements 44, 46, 47, 48, 51, 52, 53, 54, 56 and 57. Each bail has an elongated slot 61 in which the joystick extension 41 freely rides for all pivoting motion in the plane of the bail, so that each bail senses only motion in the plane orthogonal to its own.

Figure 3:
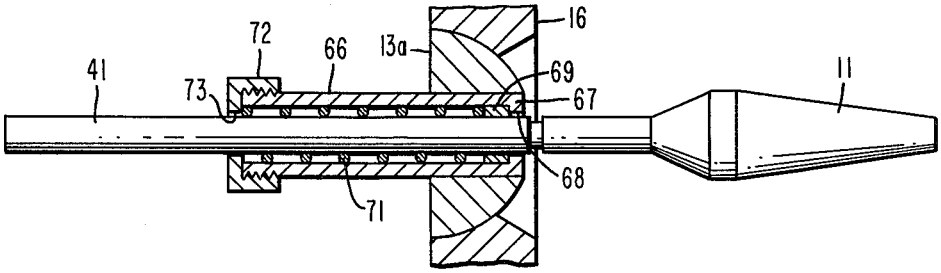
FIG. 3 is a fragmentary cross-sectional view of a different embodiment of a portion of the apparatus shown in FIG. 1.

In some uses it is of advantage to be able to make a signal in the neutral position, and for this purpose, an insulated dome switch 62 may be mounted on a bottom wall 63 of the box 29 on the axis of joystick extension 41 but remote from its end. When it is desired to make a signal, the joystick 11 may be manually depressed along its axis to activate the switch 62, and the spring 22 returns the joystick to its full neutral position when manual constraint is released. A further embodiment of the joystick is shown in FIG. 3, for use with the switch 62 without the need of unseating the bearing member 13 from its seat in the journal member 16. In this embodiment a tubular housing 66 is press-fitted in the bearing member **13*a*. The housing 66 has an end wall 67 containing an opening 68 through which the joystick extension 41 rides, and a stop member 69 is secured to extension 41 to engage the inner side of end wall 67 to limit motion of the joystick in an upward direction. A helical spring 71 urges the joystick in the upward direction and is retained by an end cap 72 screwed onto the lower end of housing 66. The end cap 72 also has an opening 73 for sliding motion of the joystick extension 41**.

For proper functioning of the apparatus shown in FIG. 3, it is of advantage to have a spring 71 that is very much weaker than the spring 22, so that only the spring 71 will be appreciably distorted when the joystick is depressed to activate the switch 62.

I claim:

1. A joystick control of the type having a base and universal joint means including bearing and journal members, with the joystick attached to one of said members for universal pivoting motion with respect to said base for manual positioning in a range of desired inclinations in at least two orthogonal planes, and bail and signal means positionable by pivoting of said joystick to indicate the joystick inclinations in at least said two orthogonal planes, characterized in that:

said universal joint means is comprised by only one single bearing member and only one single journal member presenting mating faces substantially conforming to at least portions of a predetermined spherical surface;

said one member to which said joystick is attached presents at least one other face intersecting said spherically surfaced face thereof;

springy tilting displacement means are provided for engaging said other face for tilting displacement by said joystick when the joystick is manually pivoted from corresponding neutral positions to corresponding displaced positions, respectively;

said springy displacement means including at least one spring mounted directly on said base, said spring being biassed toward said neutral position thereof, and being coupled to said joystick for concomittant return of the joystick to the neutral position thereof when the joystick is released from manual constraint.

2. A joystick control as described in claim 1, further characterized in that:

said bearing member is a convex hemispherical member with said joystick extending from the central pole thereof, and the journal member has a cavity of concave hemispherical shape and defines a frustro-conical-walled polar through opening for pivoting of said joystick through said range of inclinations.

3. A control as described in claim 2, wherein said displacement means includes:

a plate having a neutral position bearing against the equatorial flat sides of said bearing and journal members in the neutral position of said joystick; and a spring member engaging said plate and biassed to hold said plate resiliently against said bearing and journal members;

whereby, when said joystick and hemispherical bearing member are manually pivoted away from said neutral positions thereof, said plate is urged by said spring to push against the equatorial edge portion of said bearing member that protrudes from said journal member, so as to provide a return moment urging said bearing member and joystick to return to the neutral positions thereof.

4. A control as described in claim 3, wherein said spring member is a helical coil compression spring arranged with the axis generally normal to said plate and retained in loaded compression against said plate by means of a cup member having side walls engaging said journal member and secured thereto, and an end wall engaging the end of said helical spring opposite to the end that engages said plate.

5. A control as described in claim 4, wherein said joystick has an elongated extension away from the flat side of said bearing member to engage said bail means, said plate and said cup end wall having central openings to permit pivoting of said extension throughout said range of inclinations of said joystick.

6. A control as described in claims 2 and 5, wherein a box-like housing is provided for secured engagement to said journal member for the mounting of said bail and signal means;

said signal means being a pair of rotational potentiometer assemblies mounted on side walls of said housing so as to be axially orthogonally related to each other and to said joystick extension in the neutral position thereof; and said bail means being a pair of elongated semi-circularly curved members the diametrically opposite ends of which are secured one each to a different one of the rotating portions of said potentiometers, and the other end each for rotation with respect to a side wall portion of said housing diametrically opposite to the corresponding potentiometer;

each of said curved members having a central slot along the curved length thereof facing said bearing member, with said joystick extension passing through both of said slots.

7. A control as described in claim 6, wherein:

an insulated dome switch is mounted on an inside wall of said housing on the axis of said joystick extension in the neutral position thereof, and;

said joystick and its extension are formed as a single element mounted for manually-produced sliding motion through said bearing member to engage and activate said dome switch in the neutral position of said joystick, said joystick being spring-loaded toward a neutral position remote from said dome switch so as to be disengaged from said dome switch upon release of manual constraint.

* * * * *